US007622858B2

(12) United States Patent
Lin et al.

(10) Patent No.: US 7,622,858 B2
(45) Date of Patent: Nov. 24, 2009

(54) PLANAR LIGHT SOURCE GENERATING APPARATUS

(75) Inventors: Wei-Yi Lin, Yunlin County (TW); Biing-Nan Lin, Taichung (TW); Ming-Chun Hsiao, Hsinchu County (TW); Liang-You Jiang, Taipei County (TW)

(73) Assignee: Industrial Technology Research Institute, Hsinchu (TW)

( * ) Notice: Subject to any disclaimer, the term of this patent is extended or adjusted under 35 U.S.C. 154(b) by 359 days.

(21) Appl. No.: 11/426,942

(22) Filed: Jun. 28, 2006

(65) Prior Publication Data

US 2007/0164656 A1 Jul. 19, 2007

(30) Foreign Application Priority Data

Jan. 16, 2006 (TW) ..... 95101555 A

(51) Int. Cl.
*H01J 1/05* (2006.01)
*H01J 1/304* (2006.01)
*H01J 29/50* (2006.01)

(52) U.S. Cl. ..... 313/497; 313/309; 313/495; 315/169.3; 445/50; 445/51; 445/24

(58) Field of Classification Search ..... None
See application file for complete search history.

(56) References Cited

U.S. PATENT DOCUMENTS

2005/0152155 A1* 7/2005 Kang et al. ..... 362/558
2005/0179380 A1* 8/2005 Oh et al. ..... 313/581
2005/0264170 A1* 12/2005 Oh ..... 313/497

FOREIGN PATENT DOCUMENTS

CN 1133487 10/1996
CN 1637511 7/2005
CN 1702820 11/2005

OTHER PUBLICATIONS

"1st Office Action of China counterpart application", issued on Mar. 20, 2009, pp. 1-10.

* cited by examiner

*Primary Examiner*—Sikha Roy
*Assistant Examiner*—Tracie Green
(74) *Attorney, Agent, or Firm*—Jianq Chyun IP Office

(57) ABSTRACT

An apparatus for generating a planar light source and method for driving the same is provided. The apparatus for generating a planar light source comprises an emitting layer disposed not only on a cathode electrode, but also on a gate electrode as well. Accordingly, by applying an AC voltage to the apparatus, a duty cycle of the AC voltage can reach 100% so as to enhance the brightness to the extent that the apparatus is applied a DC voltage.

10 Claims, 7 Drawing Sheets

PLANAR LIGHT SOURCE GENERATING APPARATUS

CROSS-REFERENCE TO RELATED APPLICATION

This application claims the priority benefit of Taiwan application serial no. 95101555, filed on Jan. 16, 2006. All disclosure of the Taiwan application is incorporated herein by reference.

BACKGROUND OF THE INVENTION

1. Field of the Invention

The present invention relates to an apparatus for generating a light source and a method for driving the same. More particularly, the present invention relates to an apparatus for generating a planar light source and a method for driving the same.

2. Description of the Related Art

The principle of light emission in a field emission display device is based on the occurrence of electron emission at a tip of material in a vacuum environment due to there existing a strong electrical field. These field-emitted electrons leaving a cathode plate accelerate toward a positively charged anode plate and ultimately bombard with fluorescent material disposed thereon to produce light. Conventionally, the cathode plate serves as a source for producing the field electrons and the anode plate serves as a light source. FIG. 1 is a diagram showing a conventional field emission apparatus. As shown in FIG. 1, the electrons emitted from the cathode plate 10 bombard the fluorescent layer 201 disposed on the anode plate 20 to produce light. The cathode plate 10 includes a glass substrate 102 and a gate and emitting layer 101 disposed on the glass substrate 102. FIG. 2 is a top view showing a conventional cathode, a gate and an emitting layer 101, which comprises a plurality of stripe gates 101*a* and a plurality of stripe cathodes 101*b* disposed alternately. Furthermore, a plurality of emitting layers 101*c* is formed on the stripe cathodes 101*b*.

The anode plate 20 comprises a glass substrate 203, a conductive reflection layer 202 and a fluorescent layer 201. Furthermore, a heat sink 30 is disposed on the glass substrate 203. The fluorescent layer 201 is fabricated using a fluorescent powder capable of generating the three primary colors, i.e. red, blue and green, for producing white light or simply fabricated using a white fluorescent powder. The electron emission layer 101*c* is fabricated using a material with a lower work function, for example, molybdenum (Mo), titanium carbide (TiC), tungsten (W), silicon (Si) or carbon nanotube. Thus, the material layer can be used as an emission source for the electron emission layer. The electrons emitted from the emitting layer disposed on the cathode plate 10 bombard against the fluorescent layer 201 disposed on the anode plate 20 and then produce a mixture of red, blue and green light (that is, white light is thus generated) or directly produce white light if the white fluorescent powder is used. However, the conductive reflection layer 202 disposed on the anode plate 20 reflects the white light. The reflected white light may penetrate through the cathode plate 10 and exit from another surface 10*a* of the cathode plate 10. Thus, if the field emission display device is used as a back light source, the display device is so disposed closely to the cathode plate, in which the surface of the display device facing the cathode plate 10*a* is used as a light-receiving surface.

As the reflected light needs to penetrate the cathode plate, an electrode layer and a gate layer of the cathode plate are designed in such a way that they are simultaneously formed at a same layer during a same fabricating step. Furthermore, when the field emission display serves as the back light source for other devices, it is able to generate a planar light source with more uniformly-distributed brightness than other light source, such as, a cold cathode fluorescent lamp (CCFL) or a light-emitting diode (LED). The electrode and the gate of the cathode plate are driven by an AC voltage to produce electrons capable of bombarding the fluorescent layer 201. However, a way of using the AC voltage to drive the cathode plate has a drawback of a transition between light turned on and off; whereas, the transition is too short to be perceptible by human eyes. In practice, a brightness level of field emission planar light source driven by the AC voltage is affected by a duty cycle thereof. Although a DC voltage is the most direct way for producing a certain level of brightness of the display device, it thereby causes a serious advantage of larger power consumption. Therefore, a method for driving the light source apparatus with the AC voltage while retaining the same brightness level as driven with the DC voltage is an important issue for a manufacturer of the light source apparatus.

SUMMARY OF THE INVENTION

Accordingly, one objective of the present invention is to provide an apparatus for generating a planar light source comprising a structure in which a plurality of stripe gates and a plurality of stripe cathodes are interleaved. Furthermore, a plurality of emission layers is formed not only on the stripe cathodes but also over the stripe gates so as to help the stripe gates and the stripe cathodes alternatively emit electrons.

To achieve these and other advantages and in accordance with the purpose of the invention, as embodied and broadly described herein, the invention provides an apparatus for generating a planar light source. According to a first embodiment of the present invention, a cathode is connected to the ground and a gate receives an alternating current (AC) square wave with a positive amplitude between 50 ~500V and a negative amplitude between −50~−500V. Through this driving method, a voltage difference between the cathode and the gate is positive 100V for a first period of time so that the emission layer disposed on the gate can produce electrons. Thereafter, the voltage difference between the cathode and the gate is negative 100V for a second period of time so that the emission layer disposed on the cathode can produce electrons. As such, a panel in the apparatus for generating a planar light source is always turned on to display images so as to attain the same brightness level as driven with a DC voltage.

According to a voltage driving method disclosed in a second embodiment of the planar light source generating apparatus of the present invention, the cathode and the gate are coupled to a first DC square voltage and a second DC square voltage, respectively. Furthermore, the phase difference between these two DC square voltages is greater than 0° but smaller than or equal to 180°. With this arrangement, the panel of the planar light source generating apparatus in the present invention is illuminated the same all time as the first embodiment. Consequently, the planar light source generating apparatus can attain the same brightness level as driven with the DC driven voltage.

According to a voltage driving method disclosed in a third embodiment of the planar light source generating apparatus of the present invention, the cathode is connected to the ground and the gate is electrically coupled to an AC voltage. The AC voltage has a positive amplitude between 50V~500V and a negative amplitude between −50~−500V. With this driving arrangement, the cathode and the gate are turned on alternately. Hence, the panel in the planar light source generating apparatus is illuminated all the time. Hence, the planar light source generating apparatus can attain the same brightness level as driven with the DC driven voltage.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
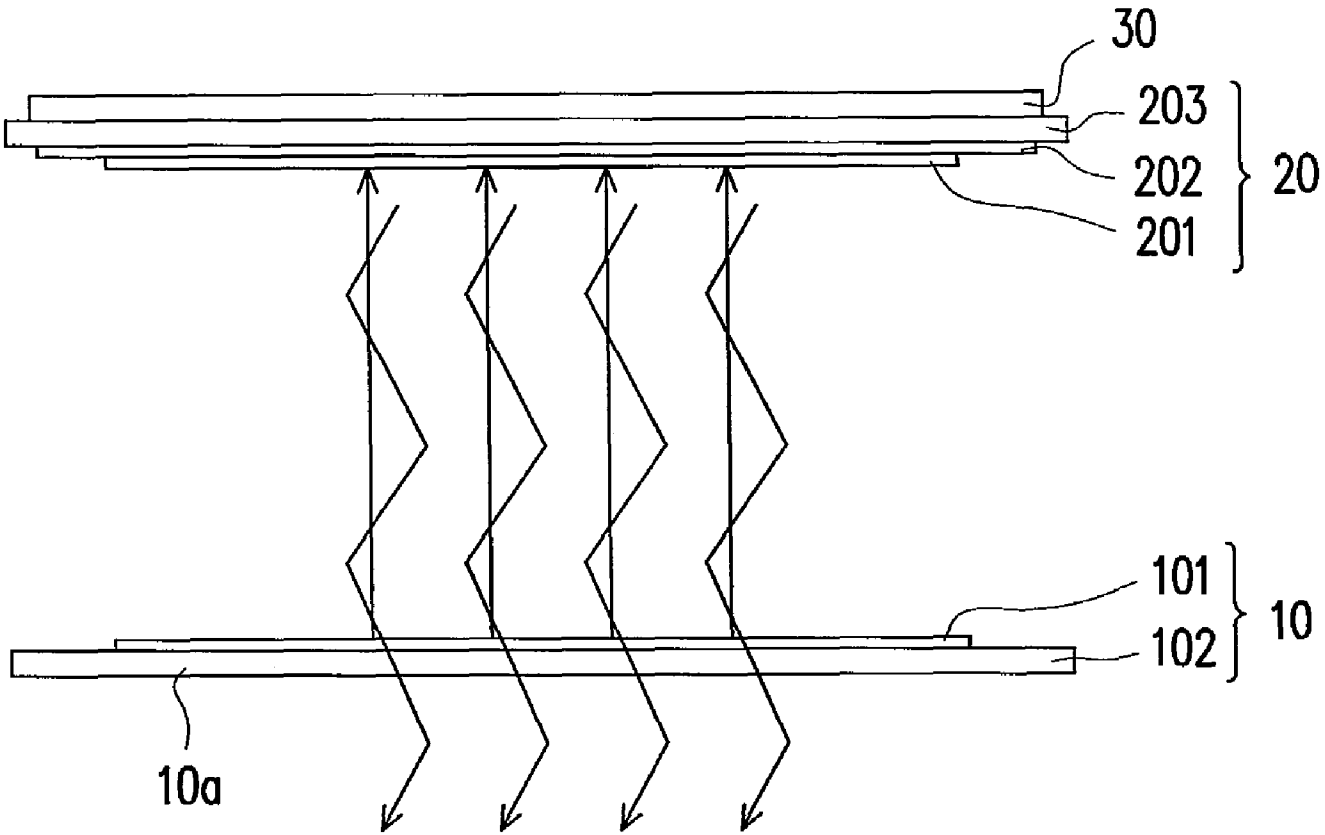
FIG. 1 (PRIOR ART)
FIG. 1 is a diagram showing a conventional field emission apparatus.
Figure 2:
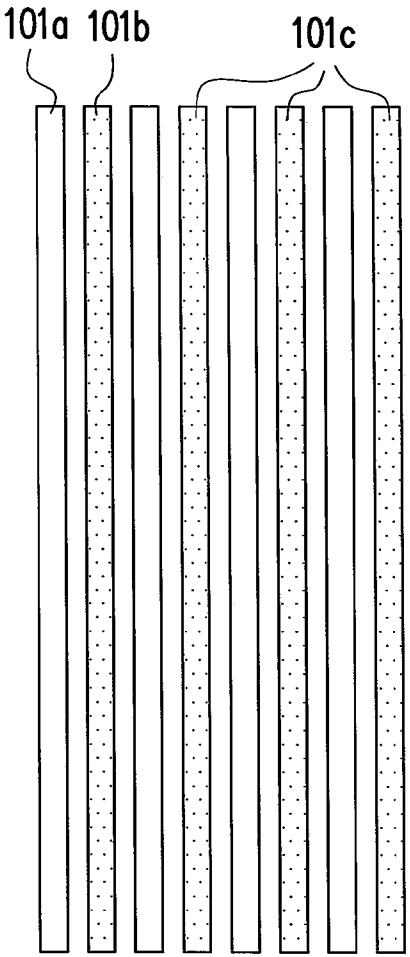
FIG. 2 (PRIOR ART)
FIG. 2 is a top view showing a conventional cathode, a gate and an electron emission layer.

Reference will now be made in detail to the present preferred embodiments of the invention, examples of which are illustrated in the accompanying drawings. Wherever possible, the same reference numbers are used in the drawings and the description to refer to the same or like parts.

According to an embodiment in the present invention, if a field emission display device (or a planar light source generating apparatus ) serves as a back light source, as the display device is disposed facing the cathode plate which is thus used as a light-receiving surface. Obviously, in another embodiment of the present invention, a conductive reflection layer 202 can be removed so that white light is able to penetrate the anode plate 20. Thus, as the display device is disposed facing the anode plate 20 which now becomes the light-receiving surface.

Figure 3B:
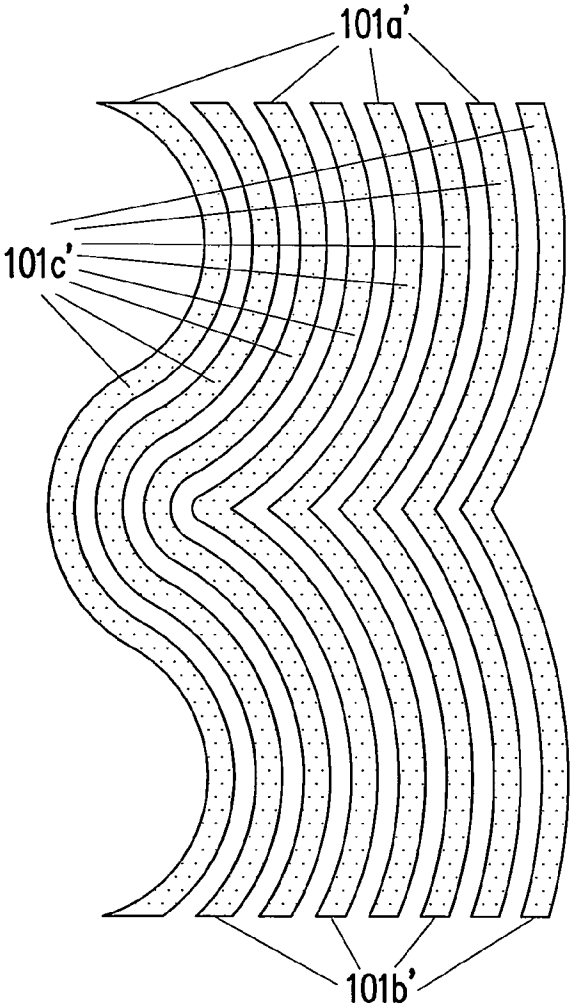
FIGS. 3A and 3B are top views showing the cathodes, the gates and the emission layers in a field emission planar light source generating apparatus according to one preferred embodiment of the present invention.
Figure 3A:
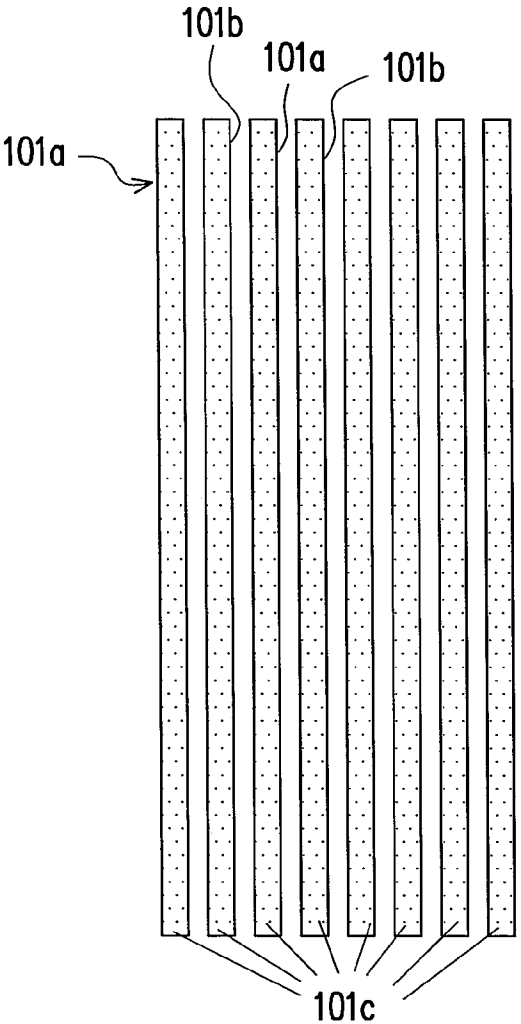

FIGS. 3A and 3B are top views showing the cathodes, the gates and the emission layers in the field emission planar light source generating apparatus according to one preferred embodiment of the present invention. To simplify the description of the embodiment, the cathodes and the gates have a stripe shape (as shown in FIG. 3A). However, the cathodes and the gates can have a wavy shape (as shown in FIG. 3B) or other geometric shapes. In FIG. 3B, 101*a*', 101*b*' and 101*c*' represent a gate, a cathode and an electron emission layer, respectively. The stripe gates 101*a* and the stripe cathodes are interleaved, but the emission layers 101*c* are disposed not only on the stripe cathodes 101*b* but also on the stripe gates 101*a* as well. The method of forming the emission layers on the stripe gate electrodes 101*a* and the stripe cathode electrodes 101*b* includes stirring synthetic carbon nanotube (or other material with field emission properties) to form a paste and spreading the carbon nanotube (CNT) paste on the aforementioned electrodes through a screen-printing process. Alternatively, the method of forming the emission layers on the stripe gate electrodes 101*a* and the stripe cathode electrodes 101*b* includes directly forming a carbon nanotube (CNT) layer or other material layer with field emission properties directly on the electrodes. Obviously, the emission layers can be fabricated using, for example, molybdenum (Mo), silicon (Si), zinc oxide (ZnO), carbon fiber or graphite.

Therefore, the electrons for bombarding fluorescent layer 201 in the planar light source generating apparatus of the present invention can be provided not only by the stripe cathodes 101*b*, but also by the stripe gates 101*a* as well. With a suitable application of an AC voltage to drive the planar light source generating apparatus, i.e., by applying an AC voltage to the gates 101*a* and the cathode 101*b*, the voltage difference between the gates and the cathodes becomes positive and negative alternately with the time. Accordingly, the gates 101*a* and the cathodes 101*b* are capable of producing electrons alternately. Hence, a panel in the planar light source generating apparatus of the present invention is always turned on so as to achieve the same brightness level as driven with a DC voltage.

Figure 4:
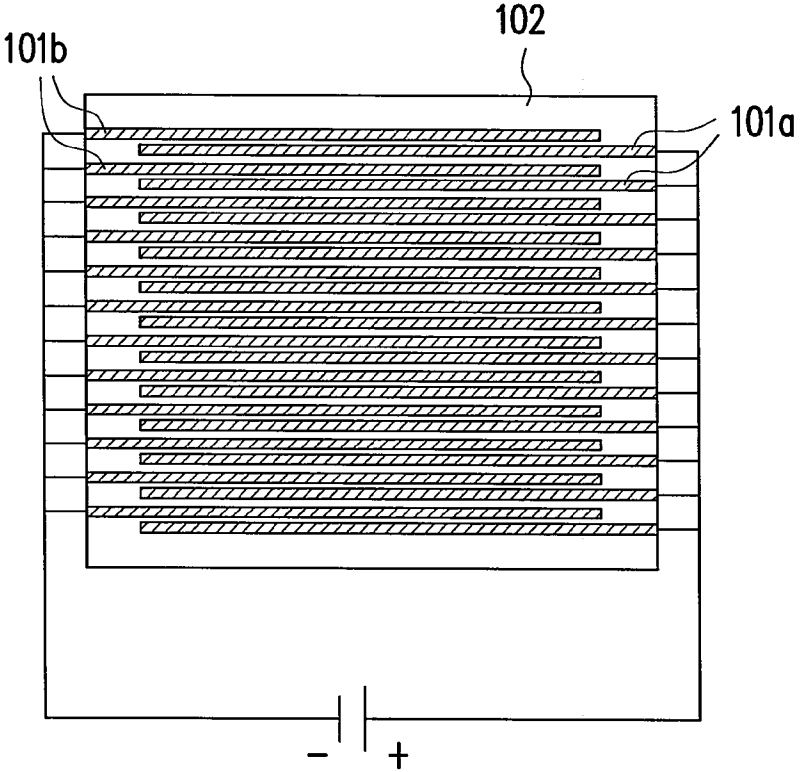
FIG. 4 is a circuit diagram showing a DC square voltage applied to the cathodes and the gates of a planar light source generating apparatus according to a first embodiment of the present invention.
Figure 6:
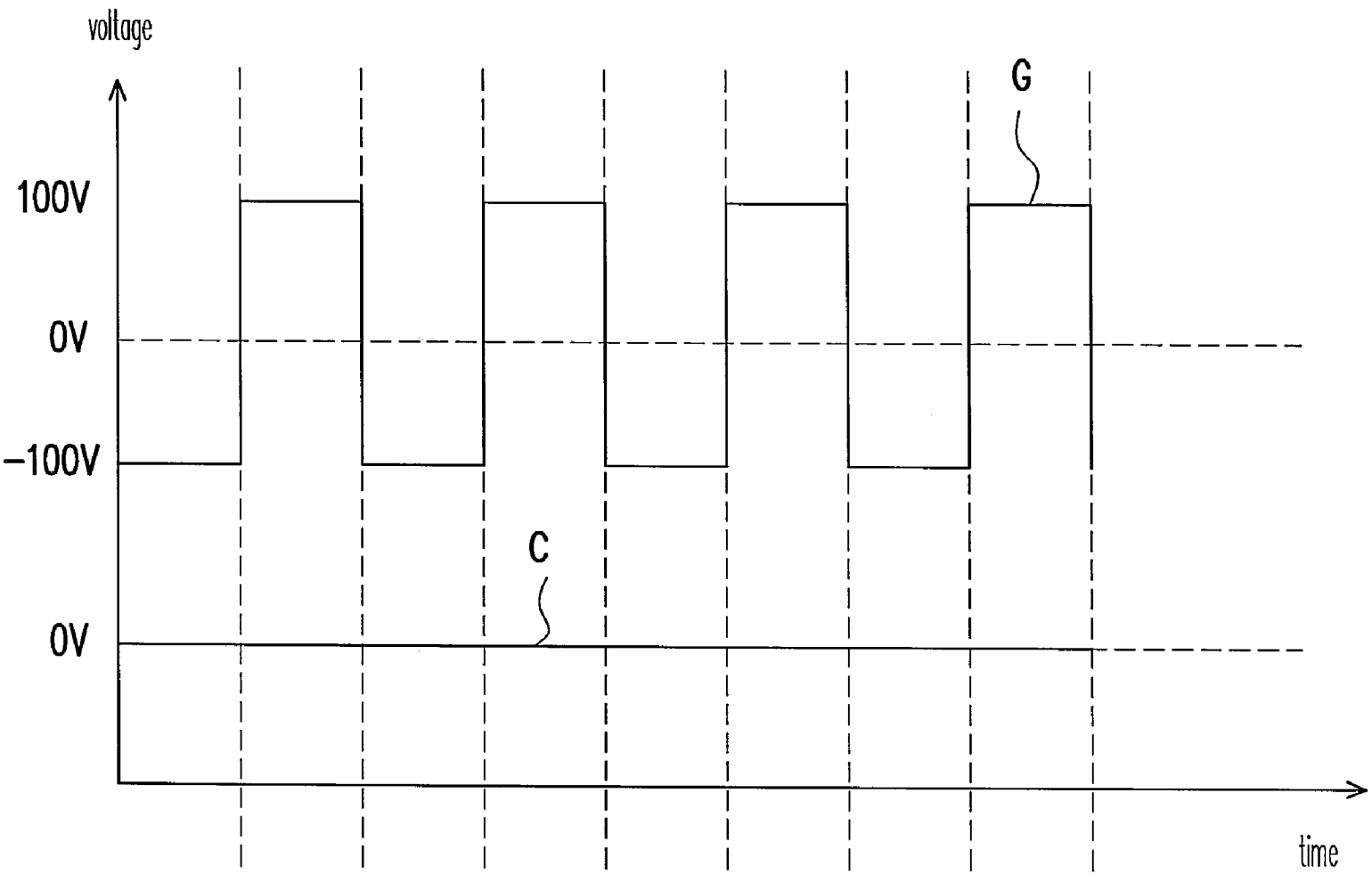
FIG. 6 is a graph showing the cathodes of a planar light source generating apparatus connected to a ground and the gates coupled to an alternating square voltage having a positive amplitude of 100V and a negative amplitude of −100V according to the present invention.

FIG. 4 is a circuit diagram showing a DC square voltage applied to the cathodes 101*b* and the gates 101*a* of a planar light source generating apparatus according to a first embodiment of the present invention. As shown in FIG. 4, a transparent glass substrate is labeled 102. Furthermore, the plurality of stripe cathodes 101*b* is grounded as shown by the C line in FIG. 6. The plurality of gates 101*a* are coupled to the AC square voltage having a positive amplitude of 100V and a negative amplitude of −100V as shown by the G line in FIG. 6. Using this driving method, the voltage difference between the cathodes 101*b* and the gates 101*a* is positive 100V during a first period (from time t=0 to the first dash line) so that the emission layers 101*c* disposed on the stripe gates 101*a* produce electrons. Similarly, the voltage difference between the cathodes 101*b* and the gates 101*a* is negative 100V during a second period (from the first dash line to the second dash line) so that the emission layers 101*c* disposed on the stripe cathodes 101*b* produce electrons. As a result, the panel of the planar light source generating apparatus is always turned on so as to achieve the same brightness level as driven with the DC voltage. Obviously, the amplitude range of the AC square voltage can be set in such as way that the positive amplitude is between 50V~500V and the negative amplitude is between −50V~−500V.

Figure 5:
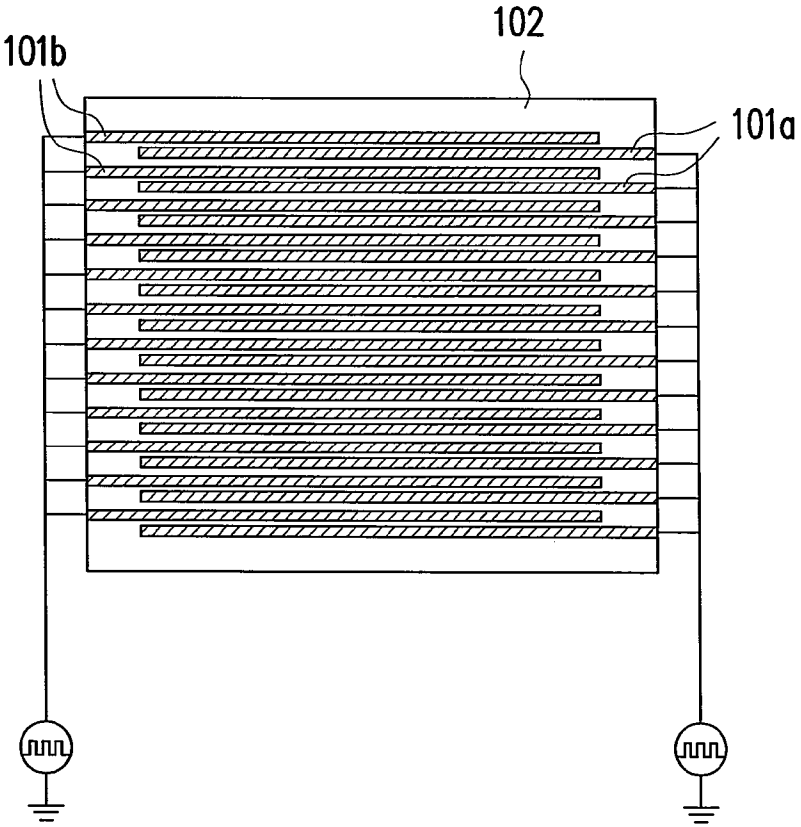
FIG. 5 is a circuit diagram showing a driving voltage applied to the cathodes and the gates of a planar light source generating apparatus according to a second embodiment of the present invention.

FIG. 5 is a circuit diagram showing a driving voltage applied to the cathodes and the gates of a planar light source generating apparatus according to a second embodiment of the present invention. As shown in FIG. 5, the stripe cathodes 101*b* and the stripe gates 101*a* are coupled to a first DC square voltage and a second DC square voltage, respectively. Furthermore, the phase difference between these two DC square voltages is greater than 0° but smaller than or equal to 180°.

Figure 7:
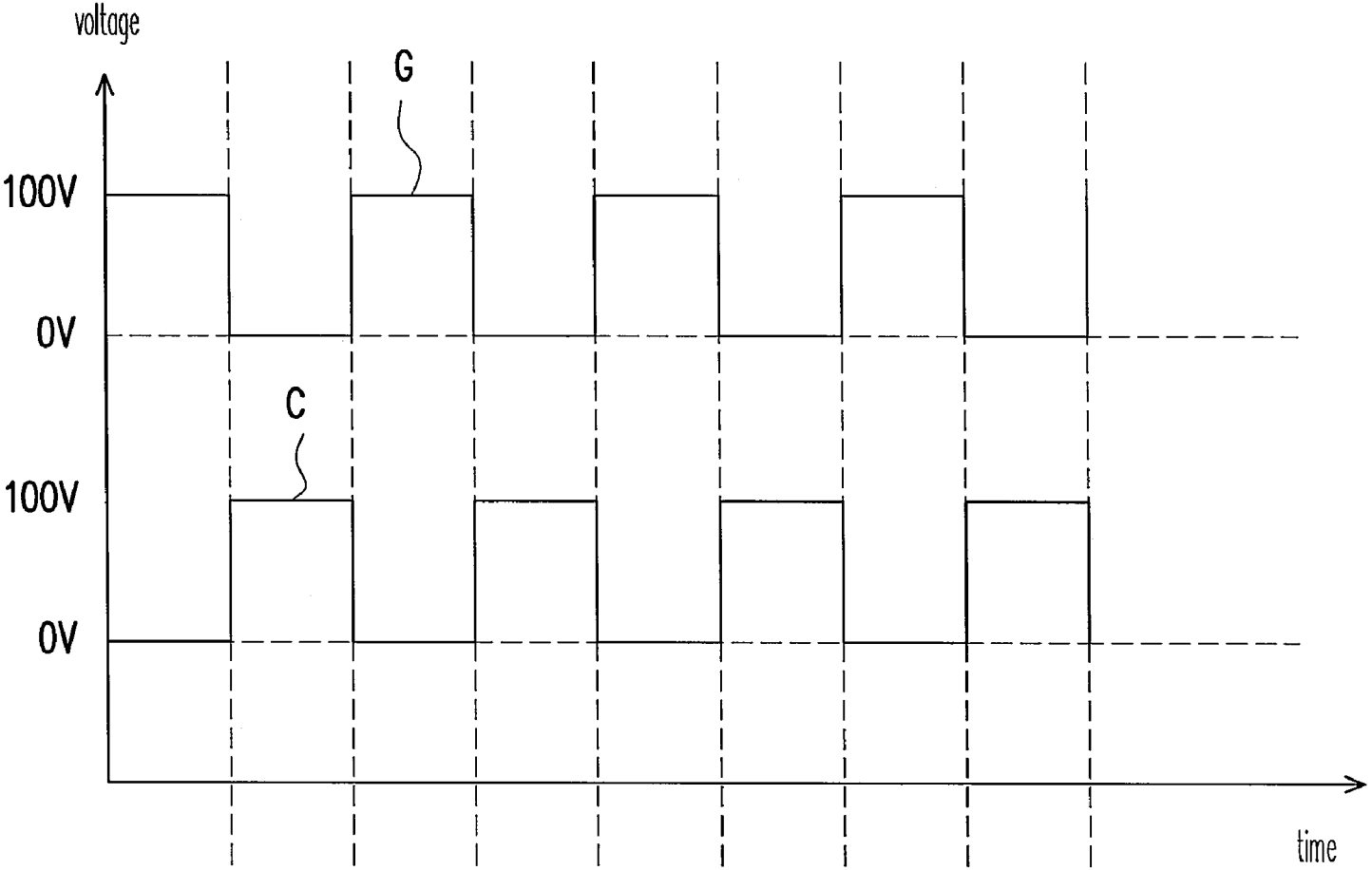
FIG. 7 is a graph showing a first DC square voltage applied to the cathodes and a second DC square voltage applied to the gates according to the present invention have a phase difference of 180°.

As shown in FIG. 7, the phase difference between the second DC square voltage G of the plurality of stripe gates 101*a* and the first DC square voltage C of the plurality of stripe cathodes 101*b* is greater than 0° but smaller than or equal to 180°. Thus, the panel in the planar light source generating apparatus of the present invention is always turned on so as to achieve the same brightness level as driven with the DC voltage.

Figure 8:
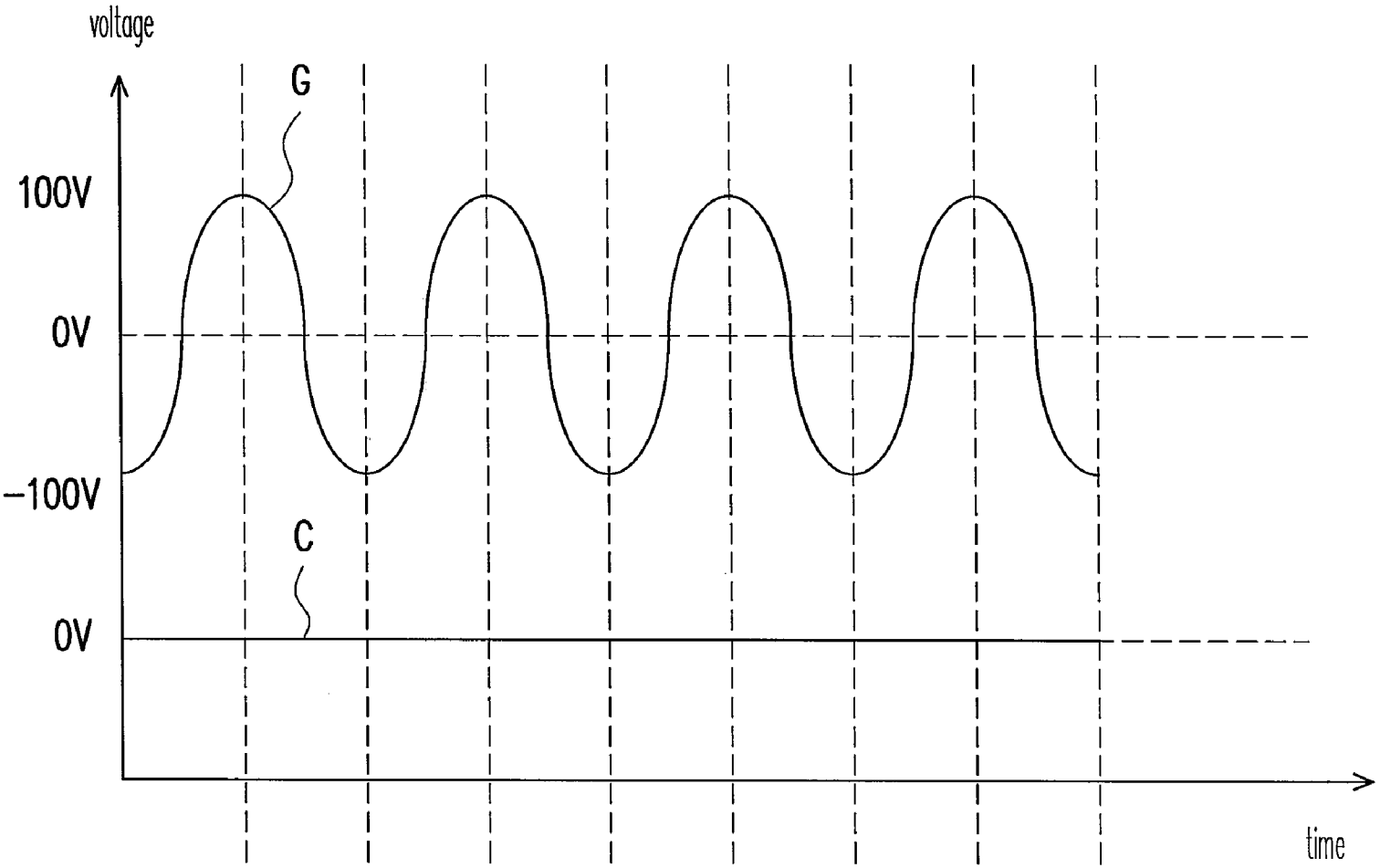
FIG. 8 is a graph showing the cathodes is connected to the ground and the gates is coupled to an AC voltage having a positive amplitude of 100V and a negative amplitude of −100V, according to the present invention.

According to the third embodiment of the present invention, that is, according to FIG. 8, the stripe cathodes 101*b* are connected to a ground while the stripe gates 101*a* are electrically coupled to an AC voltage G having a positive amplitude of 100V and a negative amplitude of −100V. Through this driving mechanism, the stripe cathodes 101*b* and the stripe gates 101*a* are alternately turned on to produce electrons. Therefore, the planar light source generating apparatus in the present invention is in an illuminated state at all times so that the apparatus driven with the AC voltage can achieve the same brightness level as driven with the DC voltage. Obviously, the amplitude range of the AC voltage G can be set in such as way that the positive amplitude is between 50V~500V and the negative amplitude is between −50V~−500V.

In summary, the emission layers in the cathode plate are formed not only on the stripe cathodes 101*b* but also on the stripe gates 101*a* as well in the present invention. Together with the voltage driving methods according to the three embodiments, the planar light source generating apparatus in the present invention is in an illuminated state at all times so that the apparatus driven with the AC voltage can achieve the same brightness level as the DC voltage.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A planar light source generating apparatus, comprising:

an anode plate, comprising a first glass substrate and a fluorescent layer;

a cathode plate disposed on the anode plate, comprising a second glass substrate, a plurality of cathodes, a plurality of gates and a plurality of electron emission layers, wherein the cathodes and the gates are interleaved and disposed on the second glass substrate, and the electron emission layers entirely covers each top surface of the cathodes and the gates.

2. The planar light source generating apparatus of claim 1, wherein the anode plate further includes a conductive reflection layer.

3. The planar light source generating apparatus of claim 1, wherein the anode plate further includes a heat sink disposed on the first glass substrate.

4. The planar light source generating apparatus of claim 1, wherein the cathodes have a stripe shape, a wavy shape or another regular geometric shape.

5. The planar light source generating apparatus of claim 1, wherein the gates have a stripe shape, a wavy shape or another regular geometric shape.

6. The planar light source generating apparatus of claim 1, wherein the electron emission layers are formed on the cathodes and the gates by virtue of stirring synthetic carbon nanotube (CNT) into a paste and spreading a layer of the carbon nanotube paste on the cathodes and the gates in a screen-printing process.

7. The planar light source generating apparatus of claim 1, wherein the electron emission layers are formed on the cathodes and the gates by virtue of directly forming a carbon nanotube layer on the cathodes and the gates.

8. The planar light source generating apparatus of claim 6, wherein the material of the electron emission layer is selected one of a group consisting of molybdenum (Mo), silicon (Si), zinc oxide (ZnO), carbon fiber and graphite.

9. The planar light source generating apparatus of claim 1, wherein the fluorescent layer is fabricated by the use of a fluorescent powders capable of producing red, blue and green light so that the fluorescent layer can generate a light mixture (that is, white light) comprising of red, blue and green colors when bombarded with electrons from the electron emission layers.

10. The planar light source generating apparatus of claim 1, wherein the fluorescent layer can be fabricated by the use of a fluorescent powder capable of producing white light.

* * * * *